US009061436B2

(12) United States Patent
Fisher et al.

(10) Patent No.: US 9,061,436 B2
(45) Date of Patent: Jun. 23, 2015

(54) STAGED CONTACT SPLITTING BLADE ASSEMBLY

(76) Inventors: Brent A. Fisher, Sparta, WI (US); Anthony B. Fisher, Sparta, WI (US)

( * ) Notice: Subject to any disclaimer, the term of this patent is extended or adjusted under 35 U.S.C. 154(b) by 1084 days.

(21) Appl. No.: 13/068,204

(22) Filed: May 5, 2011

(65) Prior Publication Data

US 2015/0013842 A1 Jan. 15, 2015

Related U.S. Application Data

(60) Provisional application No. 61/395,301, filed on May 11, 2010.

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/005; B27L 7/06; B27L 7/08
USPC ..... 144/193.1–195.9; 30/299; 83/874, 857, 83/402
See application file for complete search history.

(56) References Cited

U.S. PATENT DOCUMENTS 346,672 A * 8/1886 Miller ..... 144/193.1
1,364,737 A * 1/1921 Dudley ..... 144/195.5
1,477,106 A * 12/1923 Caldwell ..... 83/425.3
4,353,401 A 10/1982 Schilling
4,371,020 A 2/1983 Barnes et al.
4,434,825 A 3/1984 Blomqvist et al.
4,782,866 A 11/1988 Valdez
4,805,676 A 2/1989 Aikins
5,711,357 A 1/1998 Smith
6,991,010 B1 1/2006 Smith
7,104,295 B2 9/2006 Heikkinen et al.
7,104,296 B2 9/2006 Heikkinen
7,108,029 B2 9/2006 Albright

* cited by examiner

*Primary Examiner* — Shelley Self
*Assistant Examiner* — Matthew G Katcoff
(74) *Attorney, Agent, or Firm* — Tipton L. Randall

(57) ABSTRACT

A staged contact, splitting blade assembly for splitting log sections into firewood having specific dimensions. The blade assembly has an entry end and an exit end. The assembly includes radial and bridging splitting blades, arranged in a geometric pattern around a linear axis. Each radial blade has a double tapered, cutting edge, facing the entry end of the assembly, and each bridging blade has a single tapered, cutting edge, facing the entry end of the assembly. Each succeeding blade is offset from the prior blade, such that a log section contacts the splitting blade assembly in the sequence a first blade, a second blade, a third blade, fourth blades, fifth blades, sixth blades and seventh blades. The bridging blades are positioned at a slight angle to the linear axis of the splitting blade assembly.

20 Claims, 6 Drawing Sheets

STAGED CONTACT SPLITTING BLADE ASSEMBLY

CROSS-REFERENCE TO RELATED APPLICATIONS, IF ANY

This application claims the benefit under 35 U.S.C. §119 (e) of provisional application Ser. No. 61/395,301, filed 11 May 2010. Application Ser. No. 61/395,301 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY Not applicable.

BACKGROUND OF THE INVENTION

1. Field of the Invention

The present invention relates to a blade and, more particularly, to a splitting blade for splitting wood and, most particularly, to a multi-level splitting blade for splitting log sections into firewood having specific dimensions on any and all sides 2. Background Information It is common practice to split log sections into smaller pieces to provide firewood that burns readily. This can be done manually with a mall and wedge, but the process is labor intensive and requires physical strength and endurance. In recent years, hydraulic cylinders have been used to push a section of log against a stationary wedge to split the log section into smaller pieces. The simple wedge has been replaced by devices having multiple cutting edges to divide the log section into smaller pieces with a single stroke of the hydraulic cylinder. Although numerous variations on the cutting wedge, also termed a splitting blade, have been developed, nearly all are subject to plugging and binding when attempting to split the log section into many smaller pieces in a single pass through the splitting blade.

Some examples of inventions involving devices or systems for cutting and splitting log sections for which patents have been granted include the following.

Schilling, in U.S. Pat. No. 4,353,401, describes a method and apparatus for splitting a log substantially along the grain into a plurality of sector-shaped segments. The apparatus comprises at least one sector splitter ring having a plurality of blades, a support for locating the splitter ring in a log movement path, means for pushing the log axially along a log movement path, a rotating backplate for supporting one end of the log being pushed along. The backplate is adapted to tilt and allow the backplate-supported end of the log to rotate as the log is pushed through the splitter ring. A guide means retains the floating backplate in the log movement path. The process comprises forcing one end of a log axially against and through at least one splitting blade. The other end of said log is in contact with a backplate that can tilt, and permits relative rotation between the log and the splitting blade, so that a split occurs in the log from the splitting blade substantially tends to follow the grain in the log. Multiple blades and spacers are shown in FIG. 9. All blades and spacers have radial spokes that meet at the center of the circular units.

In U.S. Pat. No. 4,371,020, Barnes et al. disclose a process for preparation of long wood strands. Long wood strands are required for the production of structural lumber products. These strands must be split, and a method of splitting logs into longitudinal-grain wood strands comprises the steps of radially splitting a log substantially along the grain of the log into a plurality of sectors shaped segments. Parallel splitting each of the sector shaped segments along the grain of the segments into a plurality of substantially parallel slabs, and further splitting each of the parallel slabs substantially along the grain of the slabs into a plurality of longitudinal-grain wood strands. Circular rings with spoke-like cutting blades are disclosed, which are similar to the Schilling patent.

Blomqvist et al., in U.S. Pat. No. 4,434,825, describe a firewood cleaving apparatus that comprises a number of cleaving irons situated in four different consecutive planes. A block of wood, forced down against the cleaving irons with the aid of a ram, is stepwise split into twelve billets. The irons in the first two planes split the block in four pieces along radial lines. The iron in the third plane is annular and yields eight pieces, while the irons in the fourth plane are radial, but cleave only the radially outer pieces that were separated from the radially inner pieces by the annular cleaving iron. Note, in particular, FIGS. 3 and 4 which detail the cleaving apparatus.

In U.S. Pat. No. 4,782,866, Valdez discloses a log splitting head, which includes a downwardly-sloped top portion having a sharpened leading edge in the form of a V-shaped cutting blade. Beneath the top portion, a first row of vertical cutting blades is provided, each including a sharpened leading edge. Also included is a second row of vertical cutting blades beneath the first row of blades and structurally similar thereto. Separating the two rows of blades is a medial portion having a sharpened leading edge. The sides of the splitting head include two vertical plates having sharpened leading edges. All of these components are arranged in a specific angular configuration designed to accomplish log splitting with maximum efficiency. The entire unit is adapted for attachment to a horizontal platform and enables the splitting of logs into uniformly sized sections.

Aikins, in U.S. Pat. No. 4,805,676, describes an adjustable feed ramp that supports the input end of a main frame at a height to tilt the main frame to correspond to the inclination of a log in process. Pulled into the machine by a winch line, the leading end of the log is gripped by vertical feed rolls on a pair of side squeeze arms, a horizontal feed roll on a top squeeze arm and then by a horizontal top feed roll of hourglass shape just ahead of a vertical transverse shear blade. In a first operation, the shear blade cuts less than entirely through the log and then moves away from the input end of the main frame, sliding the log, assisted by the feed rolls, farther into the machine. This movement pushes the leading end of the log through an adjustable splitter head assembly capable of splitting the leading end portion into two, three or six pieces, as desired. A second operation of the shear blade cuts off the leading end of the log and the shear blade returns back along the main frame to its starting position to repeat the cycle on another section of the log. The various splitting blades are shown in FIGS. 12-17.

In U.S. Pat. No. 5,711,357, Smith discloses an adjustable multi-wedge splitting head for a log splitting apparatus, equipped with a ram for axially advancing precut logs toward the splitting head in a horizontal direction. The apparatus includes a vertically oriented stationary post and a stationary triangular splitting wedge disposed between the post and the log to be split. The post holds upper and lower multiple splitting wedge assemblies, which can be slideably positioned on the post by hydraulic cylinder/piston units. The triangular splitting wedge severs a log into two pieces. The wedge assemblies then sever the initially produced two pieces into smaller pieces, the number of which corresponds to the number of blades in the assembly positioned to interact with the log. The splitting blades are best seen in FIGS. 3 and 4.

Smith, in U.S. Pat. No. 6,991,010, describes a splitting head for a log splitting apparatus that includes abutting primary and secondary splitting assemblies, each having a circular securing ring that holds wedge members having cutting edges directed toward the log. The cutting edges of the secondary assembly split into smaller pieces the pieces produced by the primary assembly. The system produces a bundle of elongated pieces of firewood in parallel array and wherein the center of the bundle has not been compressed. Note the circular cutting wedges of FIGS. 3-5.

In U.S. Pat. No. 7,104,295, Heikkinen et al. disclose a log splitting system that comprises a splitter box, having top, bottom and sidewalls, and open entrance and discharge ends. A first set of cutting blades secured adjacent to the entrance end divides the entrance end into at least two, first sections. A second set of cutting blades, secured adjacent to the first set of cutting blades and opposite the entrance end, further divides each splitter box's first section into at least two, second sections. A ram assembly with a force applying surface, moveable toward the splitter box's entrance end, contacts a log with the first set of cutting blades. The ram member's surface has a plurality of surface portions, each sized to fit into one of the splitter box's first section, to further contact the log, with the second set of cutting blades splitting the log into at least four pieces. Note the multiple blades shown in FIG. 1.

Heikkinen, in U.S. Pat. No. 7,104,296, describes a log splitting system that comprises a splitter box, having entrance and discharge sections, each with top, bottom and sidewalls, and open entrance and discharge ends. A first set of cutting blades in the entrance section divides that section into at least two, first sections. A second set of cutting blades in the discharge section further divides each first section into at least two, second sections. The entrance and discharge sections are hinged at the top and pivot apart for cleaning and service. A ram assembly with a force applying surface contacts a log with the first set of cutting blades. The ram member's surface has surface portions, each sized to fit into one of the splitter box's first section, to further contact the log with the second set of cutting blades, splitting the log into at least four pieces. Note the multiple blades shown in FIG. 14.

In U.S. Pat. No. 7,108,029, Albright discloses a wood splitting machine having a plurality of wedges of various sizes and configurations, radially attached to a rotational member mounted on the frame behind the log cradle. An operator can quickly and easily rotate the appropriate wedge into position, depending on the diameter of the log in the cradle to be split. The rotational member is hydraulically actuated such that the wedges rotate around the longitudinal axis of the machine with little effort for the operator. An alternate embodiment provides that the rotational member is manually rotated, such that the wedges are rotated around the longitudinal axis of the machine by the hand of the operator. Note the various cutting wedges of FIG. 3.

Applicants have invented a splitting blade assembly that overcomes many of the short comings of the blades of the current technologies outlined above.

SUMMARY OF THE INVENTION

The invention is a staged contact, splitting blade assembly for splitting log sections into firewood having specific dimensions on any and all sides. The staged contact splitting blade assembly has an entry end and an exit end. The blade assembly comprises first, second and third planar blade members, intersecting at a common linear axis extending between the entry end and the exit end of the blade assembly. The three planar blade members extend radially from the linear axis at 60 degree intervals there between. Six (6) planar, fourth blade members each bridge a pair of adjacent first, second and third blade members to define an opening of selected dimensions. Six (6) planar, fifth blade members are each secured along a midline of one fourth blade member and extend radially outward therefrom. Twelve (12) planar, sixth blade members each bridge an adjacent pair of one fifth blade member and one of a first, a second or a third, planar blade member. Twelve (12) planar, seventh blade members are each secured along a midline of a sixth blade member and extend radially outward.

In a preferred embodiment, each radially extending, planar blade member has a double tapered cutting edge facing the entry end of the splitting blade assembly, and each bridging blade member has a single tapered cutting edge facing the entry end of the splitting blade assembly. Preferably, each succeeding blade is offset from the prior blade, such that a log section passing from the entry end to the exit end contacts the splitting blade assembly in the sequence first blade member, second blade member, third blade member, fourth blade members, fifth blade members, sixth blade members and seventh blade members.

DESCRIPTION OF THE EMBODIMENTS

Nomenclature

10 Staged Contact Splitting Blade Assembly
12 Entry End of Blade Assembly
14 Exit End of Blade Assembly
20 First Blade Member
30 Second Blade Member
40 Third Blade Member
50 Fourth Blade Members
60 Fifth Blade Members
70 Sixth Blade Members
80 Seventh Blade Members
85 Double Tapered Cutting Edge
88 Opposed Tapered Surfaces
90 Single Tapered Cutting Edge
93 Single Tapered Surface

100 Blade Subunits of Assembly
110 Mounting Channels
120 Stops for Blade Subunits
A Linear Axis of Splitting Blade Assembly
F Frame for Splitting Blade Assembly Construction The invention is a staged contact, splitting blade assembly for splitting log sections into firewood having specific dimensions on any and all sides. Distributors of split firewood now require that the firewood pieces have specific dimensions that appeal to consumers. Currently, the pieces must measure no more than 15.5 inches in length, and the width of the piece can be no more than about 4 inches on any one side. These criteria require a special blade for use in a wood splitter to produce firewood pieces that meet these criteria. The staged contact, splitting blade assembly is composed of multi-level cutting blades that sequentially divide a cylindrical piece of wood into many pieces. Each set of blades is in close proximity to the previous and following set of blades to prevent the wood pieces from binding as the pieces pass through the splitting blade device. The first, second and third blades divide the cylindrical log into 60 degree pieces. The internal space between the blades is sized to limit the dimensions of the resulting split pieces of wood. An additional set of blades beyond the first, second and third sets further divides the exterior pieces of wood into smaller pieces that meet the dimensional criteria for sale to distributors. In addition, the fourth and sixth sets of blades are oriented to the linear axis of the blade assembly at an angle of about 6 and 12 degrees, respectively, to prevent binding as the wood pieces pass through the sets of blades. Certain of the blade faces are flat, and other faces are angled to produce smooth passage of the wood pieces through the splitting blade device.

In a preferred embodiment of the invention, the radial blades of the staged contact, splitting blade assembly have opposed tapered surfaces converging to a cutting edge, and the bridging blades of the assembly have a single tapered surface, providing a cutting edge.

Figure 1:
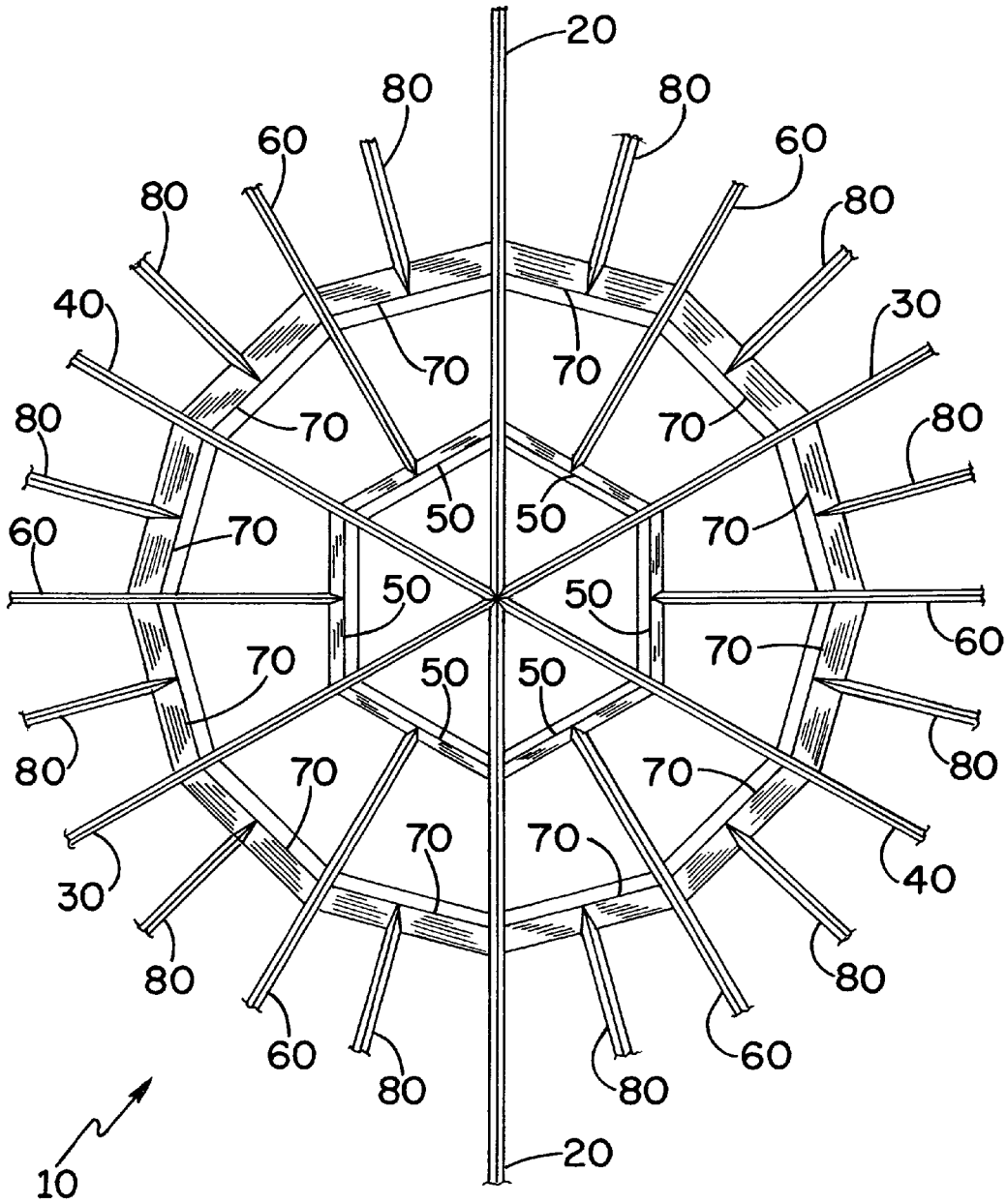
FIG. 1 is a plan view of the entry end of the staged contact, splitting blade assembly of the present invention.
Figure 4:
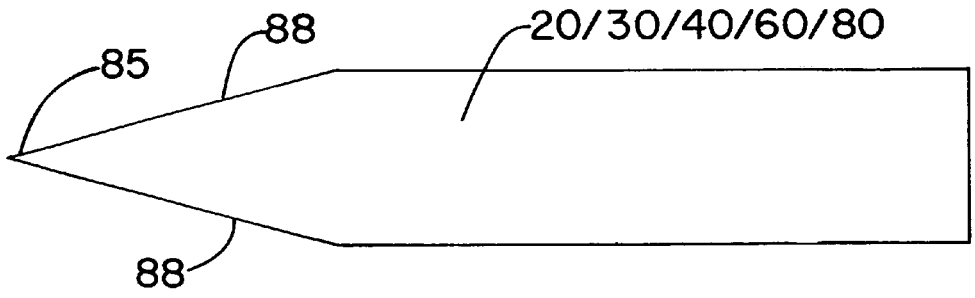
FIG. 4 is a cross sectional view of the radially oriented blade members of the staged contact, splitting blade assembly of the present invention.

Referring now to FIG. 1, an entry end view of the staged contact, splitting blade assembly 10 is shown. The blade assembly 10 includes a first, planar blade member 20, a second, planar blade member 30 and a third, planar blade member 40, intersecting at a common linear axis A extending between the entry end 12 and the exit end 14 of the blade assembly 10. The three planar blade members 20, 30, 40 extend radially from the linear axis A at 60 degree intervals there between. As illustrated in FIG. 4, each of the first, second and third, planar blade members 20, 30, 40 has opposed, tapered surfaces 88, converging to a double tapered, cutting edge 85, which faces the entry end 12 of the cutting blade assembly 10.

Figure 3:
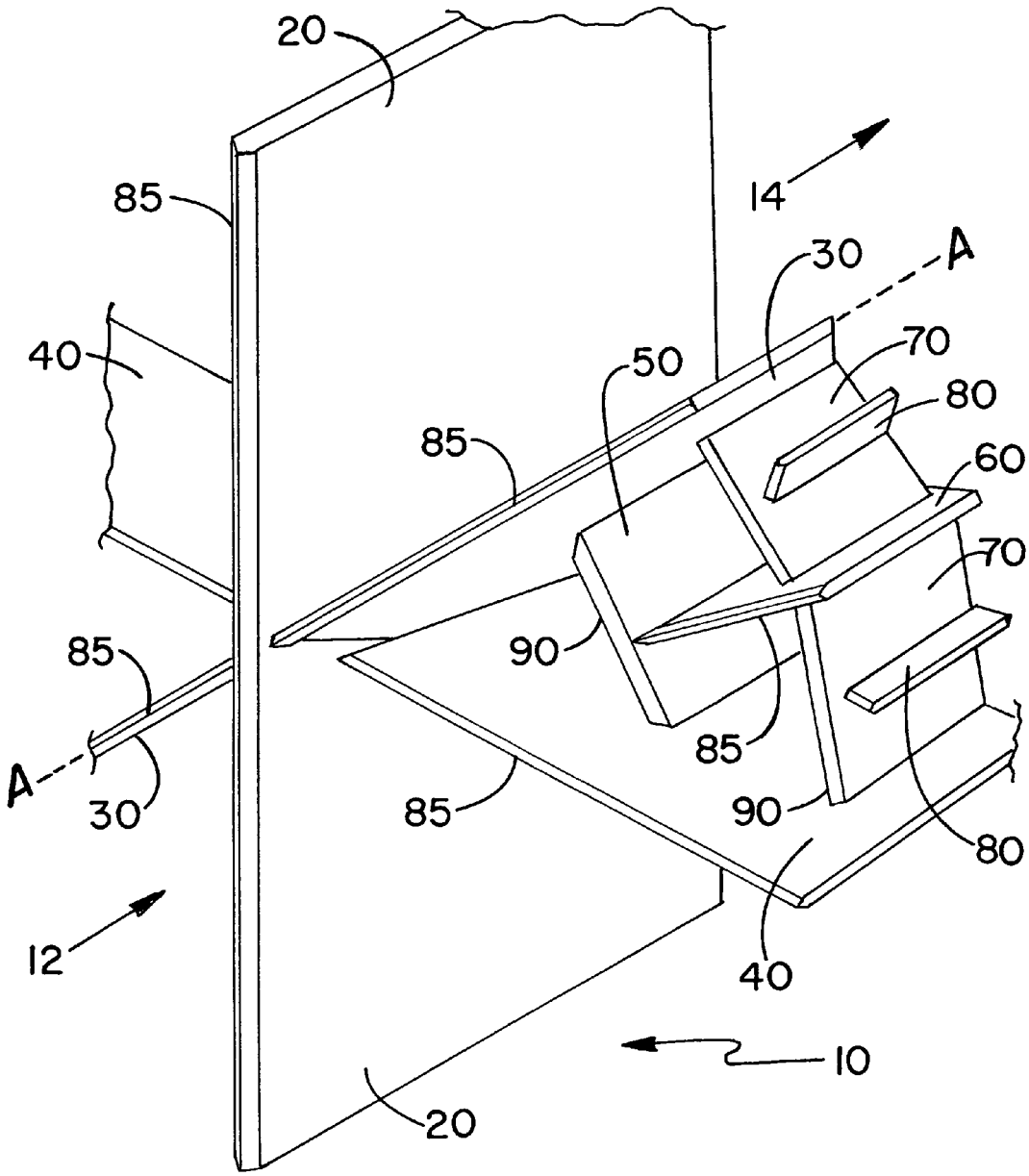
FIG. 3 is a perspective view of a portion of the individual blade members of the staged contact, splitting blade assembly of the present invention.
Figure 5:
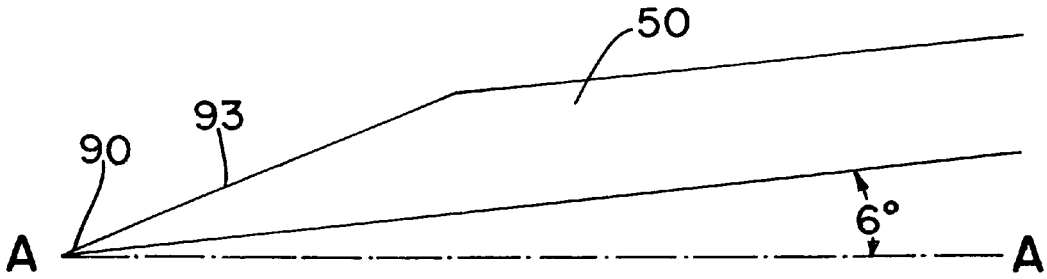
FIG. 5 is a cross sectional view of the inner ring blade members of the staged contact, splitting blade assembly of the present invention.

Referring now to FIG. 3, the cutting blade assembly 10 also includes six (6) planar, fourth blade members 50, each of which bridge a pair of adjacent first, second and third blade members 20, 30, 40 to define an opening of selected dimensions. Six (6) planar, fifth blade members 60 are each secured along a midline of a fourth blade member 50, and each extends radially outward therefrom. As illustrated in FIG. 5, each of the planar, fourth blade members 50 has a single tapered surface 93 converging to a single tapered cutting edge 90, which faces the entry end 12 of the cutting blade assembly 10.

Figure 6:
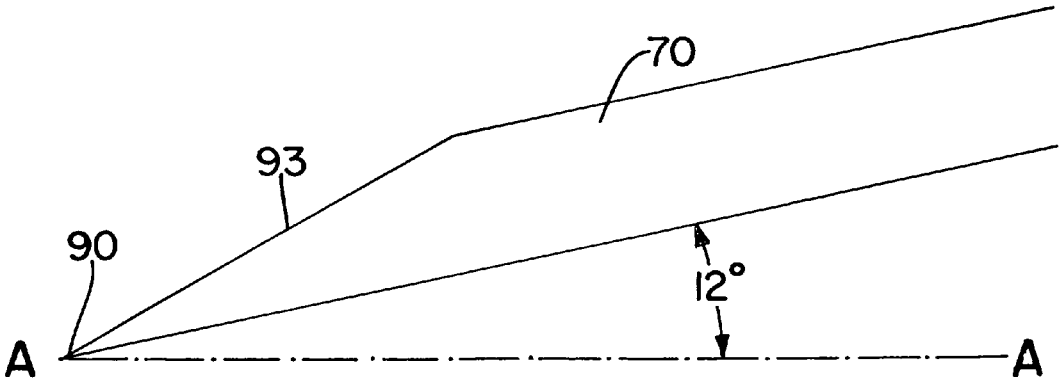
FIG. 6 is a cross sectional view of the outer ring blade members of the staged contact, splitting blade assembly of the present invention.

Referring again to FIG. 3, twelve (12) planar, sixth blade members 70 each bridge a pair of one planar, fifth blade member 60 and one of either a first, a second or a third, planar blade member 20, 30, 40. Twelve (12) planar, seventh blade members 80 are each secured along a midline of one sixth blade member 70 and each extends radially outward therefrom. As illustrated in FIG. 6, each of the sixth, planar blade members 70 has a single tapered surface 93, converging to single tapered cutting edge 90, which faces the entry end 12 of the cutting blade assembly 10.

As indicated above, each of the six (6) planar, fourth blade members 50 has a single tapered surface 93, converging to a single tapered cutting edge 90, which faces the entry end 12 of the cutting blade assembly 10. In addition, each planar, fourth blade member 50 extends between 2 and 10 degrees, and most preferably at a 6 degree angle, relative to the linear axis A of the cutting blade assembly 10, as illustrated in FIG. 5. The slight enlargement of the space between the cutting blade members prevents the split wood pieces from binding between the blade members as the wood pieces move toward the exit end 14 of the cutting blade assembly 10.

As indicated above, each of the twelve (12) planar, sixth blade members 70 has a single tapered surface 93, converging to a single tapered cutting edge 90, which faces the entry end 12 of the cutting blade assembly 10. In addition, each planar, sixth blade member 70 extends between 8 and 15 degrees and, most preferably, at about a 12 degree angle, relative to the linear axis A of the cutting blade assembly 10, as illustrated in FIG. 6. Again, the slight enlargement of the space between the cutting blade members prevents the split wood pieces from binding between the blade members as the wood pieces move toward the exit end 14 of the cutting blade assembly 10.

Figure 2:
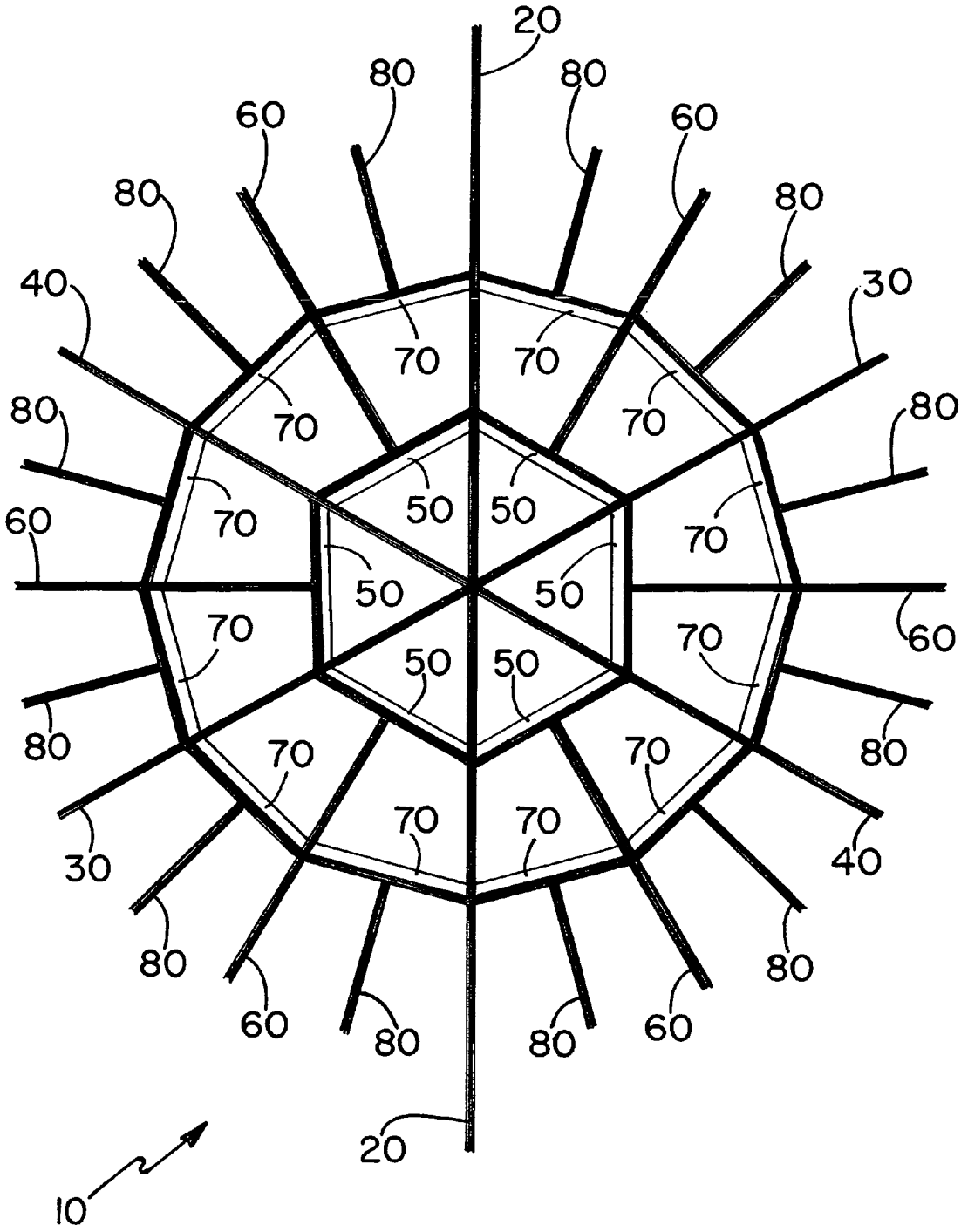
FIG. 2 is a plan view of the exit end of the staged contact, splitting blade assembly of the present invention.

Although the bridging, fourth blade members 50 and the bridging, sixth blade members 70 are illustrated as planar blades, each of the blades 50, 70 may be slightly concave to produce an essentially conical structure. In this conical structure embodiment, the bridging, fourth blade members 50 and the bridging, sixth blade members 70 are seen as circular units rather than a hexagon or dodecahedron, respectively, as shown in FIGS. 1 and 2.

Figure 8:
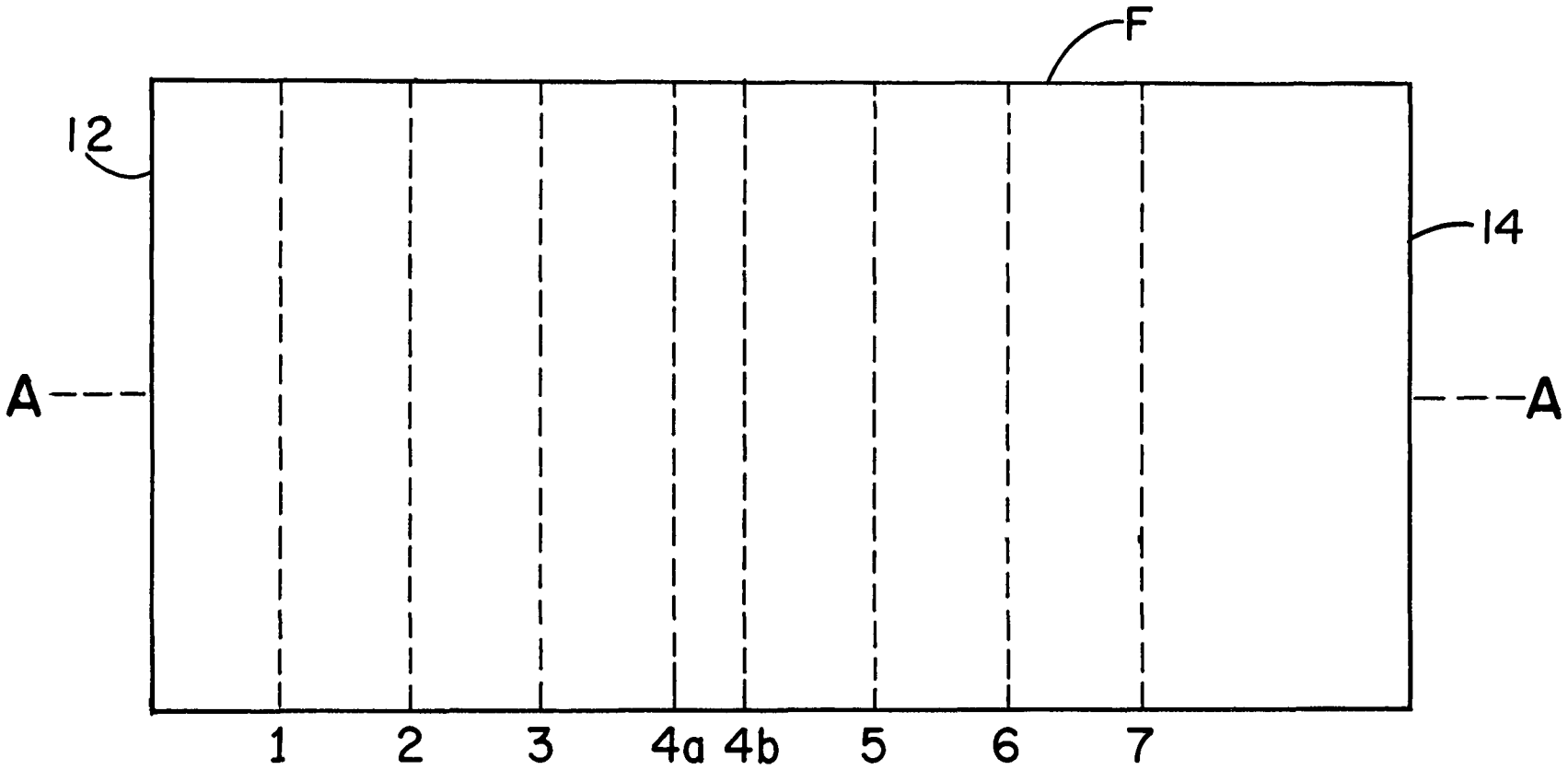
FIG. 8 is a side view of a frame, within which is secured the staged contact, splitting blade assembly of the present invention.

Another unique feature of the splitting blade assembly 10 is the placement of each blade member, relative to the entry end 12 of the blade assembly 10. In order to reduce the power requirements for pushing a log section through the splitting blade assembly 10, each succeeding blade member is positioned a short distance toward the exit end 14 of the blade assembly 10. The placement of the blade members 20, 30, 40, 50, 60, 70 within a frame F supporting the splitting blade assembly 10 is illustrated in FIG. 8. Thus, the contact of the splitting blade assembly 10 with a log section is in the sequence, the first blade member 20, the second blade member 30, the third blade member 40, the fourth blade members 50, the fifth blade members 60, the sixth blade members 70 and the seventh blade members 80, provided the log section is of a sufficient diameter. Smaller log sections are centered on the linear axis A of the splitting blade assembly 10 and may not contact all of the blade members.

In addition, the cutting edge 85 of each fifth blade member 60 and each seventh blade member 80 extends toward the entry end 12 of the splitting blade assembly 10, as the double tapered cutting edge 85 of each blade member 60, 80 extends away from the linear axis A of the splitting blade assembly 10. This orientation of the cutting edges 85 of the blade members 60, 80 functions to maintain each piece of the log section in place and to contact each succeeding blade member to provide uniform pieces of split wood, produced from a log section.

Figure 7:
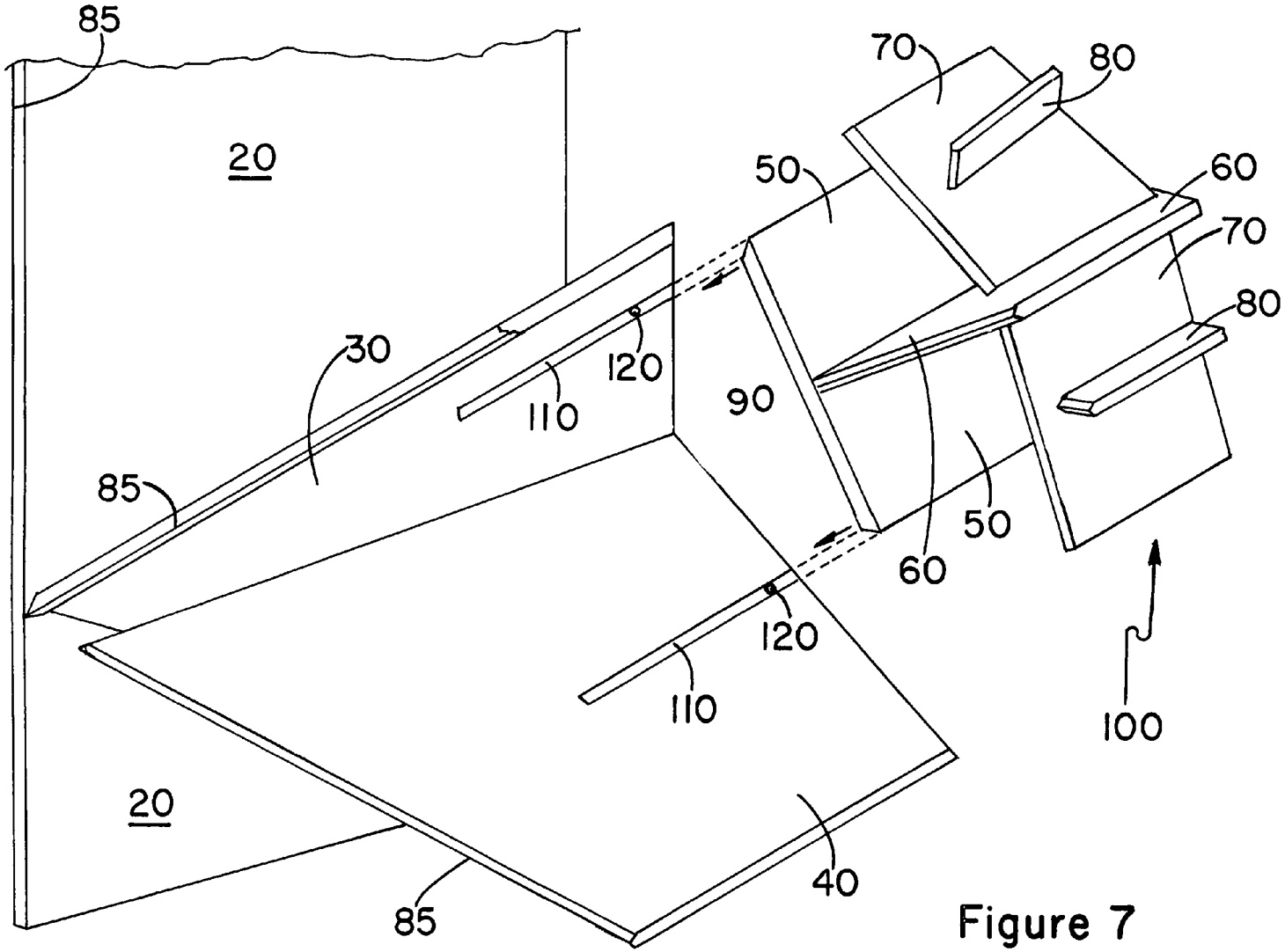
FIG. 7 is an exploded view of a blade subunit, mounted in mounting channels of the second and third blade members of the staged contact, splitting blade assembly of the present invention.

In a preferred embodiment of the invention, the splitting blade assembly 10 includes six subunits 100 made up of one (1) fourth blade member 50, one (1) fifth blade member 60, two (2) sixth blade members 70 and two (2) seventh blade members 80, best illustrated in FIGS. 3 and 7. As described above, a log section moving from the entry end 12 to the exit end 14 of the splitting blade assembly 10 sequentially contacts a fourth blade member 50, then a fifth blade member 60, then a sixth blade member 70 and finally a seventh blade member 80. In this embodiment, each subunit 100 is secured within one of the 60 degree intervals formed by the intersecting first, second and third blade members 20, 30, 40. In addition, each subunit 100 is offset from the two adjacent subunits 100, each located in an adjacent 60 degree interval. Designating the subunits 100 in the 60 degree intervals as subunits 1-6, the cutting edge 90 of the fourth blade member 50 of subunits 1, 3 and 5 are positioned in a common plane (4*a* of FIG. 8), perpendicular to the linear axis A of the blade assembly 10. The cutting edge 90 of the fourth blade member 50 of subunits 2, 4 and 6 are also positioned in a common plane (4*b* of FIG. 8), perpendicular to the linear axis A of the blade assembly 10, but offset toward the exit end 14 a selected distance from the common plane of the subunits 1, 3 and 5. Consequently, the fifth, sixth and seventh blade members associated with the subunits 100 designated as 2, 4 and 6 are offset from corresponding blade members associated with subunits 100 designated as 1, 3 and 5. Thus, the log section encounters subunits 2, 4 and 6 slightly after contacting subunits 1, 3 and 5. This design feature requires less force to drive the log section through the splitting blade assembly 10.

The first, planar blade member 20, second, planar blade member 30 and third, planar blade member 40, are welded together along the common linear axis A, extending between the entry end 12 and the exit end 14 of the blade assembly 10. The blade assembly 10 is supported by an encircling frame F, shown in FIG. 8, secured to the ends of the blade member 20, 30 40 opposite the common linear axis A. Each subunit 100 of the blade assembly 10 is welded in position for stability. Alternatively, each subunit 100 is mounted in mounting channels 110 cut into the surface of the blade members 20, 30, 40 and held in position by suitable stops 120, such as a bolt or similar fastener, as illustrated in FIG. 7. Employing mounting channels 110 to secure the subunits 100 to the blade members 20, 30, 40 allows facile replacement should a subunit 100 be damaged. Similarly, the subunits 100 can be removed from the splitting blade assembly 10 when splitting smaller diameter log sections.

As mentioned above, the blade assembly 10 is supported by an encircling frame F secured to the ends of the blade member 20, 30 40 opposite the common linear axis A. A log section splitting system employing the splitting blade assembly 10 of the present invention includes a main frame and a hydraulic ram or similar device for pushing a log section through the blade assembly 10. The general construction of such a log splitter system is well known in the industry and is not further discussed here.

While the invention has been particularly shown and described with reference to preferred embodiments thereof, it will be understood by those skilled in the art that various changes in form and details may be made therein without departing from the spirit and scope of the invention.

We claim:

1. A staged contact splitting blade assembly having an entry end and an exit end, said splitting blade assembly comprising:

first, second and third planar blade members intersecting at a common linear axis, said linear axis extending between said entry end and said exit end of said splitting blade assembly, each said first, said second and said third planar blade members passing through and extending radially from said common linear axis, with adjacent blade members having a 60 degree interval there between;

six planar fourth blade members each said fourth blade member bridging an adjacent pair of said first, said second and said third blade members to define an opening there between;

six planar fifth blade members, each said fifth blade member secured along a midline of one said fourth blade member, each said fifth blade member extending radially outward from said common linear axis;

twelve planar sixth blade members, each said sixth blade member bridging a pair of one said planar fifth blade member and one blade member selected from the group consisting of said first blade member, said second blade member and said third planar blade member; and twelve planar seventh blade members, each said seventh blade member secured along a midline of one said sixth blade member, each said seventh blade member extending radially outward from said common linear axis.

2. The staged contact splitting blade assembly having an entry end and an exit end of claim 1, wherein each said first, said second, said third, said fifth and said seventh radially extending planar blade member has a double tapered cutting edge facing said entry end of said splitting blade assembly.

3. The staged contact splitting blade assembly having an entry end and an exit end of claim 1, wherein each said fourth and each said sixth bridging blade member has a single tapered cutting edge facing said entry end of said splitting blade assembly.

4. The staged contact splitting blade assembly having an entry end and an exit end of claim 3, wherein each said bridging fourth blade member has a tapered edge oriented opposite said common linear axis and a flat edge extending from said cutting edge at between 2 degrees and 10 degrees relative to said common linear axis of said splitting blade assembly.

5. The staged contact splitting blade assembly having an entry end and an exit end of claim 3, wherein each said bridging sixth blade member has a tapered edge oriented opposite the common linear axis and a flat edge extending from a said cutting edge at between 8 degrees and 15 degrees relative to said common linear axis of said splitting blade assembly.

6. The staged contact splitting blade assembly having an entry end and an exit end of claim 1, wherein said first, said second, said third, said fourth, said fifth, said sixth, and said seventh blade members are positioned such that contact of said splitting blade assembly with a log section entering said entry end thereof is in the sequence, said first blade member, said second blade member, said third blade member, said fourth blade members, said fifth blade members, said sixth blade members and said seventh blade members.

7. The staged contact splitting blade assembly having an entry end and an exit end of claim 3, wherein said single tapered cutting edges facing said entry end of said splitting blade assembly of a first set of three alternating said fourth blade members are in a first plane and a second set of three alternating said fourth blade members are in a second plane offset from said plane of said first set of said fourth blade members.

8. The staged contact splitting blade assembly having an entry end and an exit end of claim 1, wherein said cutting edge of said fifth blade members and said cutting edge of said seventh blade member extends toward said entry end of said splitting blade assembly as each said fifth blade member's and said seventh blade member's cutting edge extends away from said common linear axis of said splitting blade assembly.

9. The staged contact splitting blade assembly having an entry end and an exit end of claim 1, wherein all fastening between blade members is by welding.

10. The staged contact splitting blade assembly having an entry end and an exit end of claim 1, wherein said splitting blade assembly includes six subunits, each said subunit including a said fourth blade member, a said firth blade member, two said sixth blade members and two said seventh blade members, each said subunit removably fastened between an adjacent pair of said first blade member, said second blade member and said third blade member.

11. A staged contact splitting blade assembly having an entry end and an exit end, said splitting blade assembly comprising:

first, second and third planar blade members intersecting at a common linear axis, said linear axis extending between said entry end and said exit end of said splitting blade assembly, each said first, said second and said third planar blade members passing through and extending radially from said common linear axis, with adjacent blade members having a 60 degree interval there between;

six planar fourth blade members each said fourth balde member bridging an adjacent pair of said first, said second and said third blade members to define an opening there between;

six planar fifth blade members, each fifth blade member secured along a midline of one fourth blade member, each fifth blade member extending radially outward from said common linear axis;

twelve planar sixth blade members, each said sixth blade member bridging a pair of one said planar fifth blade member and one blade member selected from the group comprising said first blade member, said second blade member and said third planar blade member; and twelve planar seventh blade members, each said seventh blade member secured along a midline of one sixth blade member, each said seventh blade member extending radially outward from said common linear axis;

each said first, second, third, fifth and seventh radially extending planar blade member having a double tapered cutting edge facing said entry end of said splitting blade assembly;

each said fourth and each said sixth bridging blade member having a single tapered cutting edge facing said entry end of said splitting blade assembly; and said first, said second, said third, said fourth, said fifth, said sixth and said seventh blade members are positioned such that contact of said splitting blade assembly with a log section entering said entry end thereof is in the sequence, said first blade member, said second blade member, said third blade member, said fourth blade members, said fifth blade members, said sixth blade members and said seventh blade members.

12. The staged contact splitting blade assembly having an entry end and an exit end of claim 11, wherein each said bridging fourth blade member has a tapered edge oriented opposite said common linear axis and a fiat edge extending from said cutting edge at 6 degrees relative to said common linear axis of said splitting blade assembly.

13. The staged contact splitting blade assembly having an entry end and an exit end of claim 11, wherein each said bridging sixth blade member has a tapered edge oriented opposite said common linear axis and a flat edge extending from said cutting edge at12 degrees relative to said common linear axis of said splitting blade assembly.

14. The staged contact splitting blade assembly having an entry end and an exit end of claim 11, wherein said single tapered cutting edges facing said entry end of said splitting blade assembly of a first set of three alternating said fourth blade members are in a first plane and a second set of three alternating said fourth blade members are in a second plane offset from said plane of said first set of said fourth blade members.

15. The staged contact splitting blade assembly having an entry end and an exit end of claim 11, wherein said cutting edge of said fifth blade members and said cutting edge of said seventh blade member extends toward said entry end of said splitting blade assembly as each said blade member's cutting edge extends away from said common linear axis of said splitting blade assembly.

16. The staged contact splitting blade assembly having an entry end and an exit end of claim 11, wherein all fastening between blade members is by welding.

17. The staged contact splitting blade assembly having an entry end and an exit end of claim 11, wherein said splitting blade assembly includes six subunits, each said subunit including a said fourth blade member, a said firth blade member, two said sixth blade members and two said seventh blade members, each, aid subunit removably fastened between a an adjacent pair of said first, said second and said third blade members.

18. A staged contact splitting blade assembly having an entry end and an exit end, said splitting blade assembly comprising:

first, second and third planar blade members intersecting at a common linear axis, said linear axis extending between said entry end and said exit end of said splitting blade assembly, each said first, said second and said third planar blade members passing through and extending radially from said common linear axis, with adjacent blade members having a 60 degree interval there between;

six planar fourth blade members each bridging an adjacent pair of said first, second and third blade members to define an opening there between, each said fourth blade member having a single tapered cutting edge facing said entry end of said splitting blade assembly, said tapered edge oriented opposite said common linear axis, and a flat edge extending from said cutting edge at 6 degrees relative to said common linear axis of said splitting blade assembly;

six planar fifth blade members, each fifth blade member secured along a midline of one fourth blade member, each fifth blade member extending radially outward from said common linear axis;

twelve planar sixth blade members, each sixth blade member bridging a pair of one planar fifth blade member and one blade member selected from the group comprising said first blade member, said second blade member and said third planar blade member, each said sixth blade member having a single tapered cutting edge facing said entry end of said splitting blade assembly, said tapered edge oriented opposite the common linear axis and a flat edge extending from said cutting edge at 12 degrees relative to said common linear axis of said splitting blade assembly;

twelve planar seventh blade members, each said seventh blade member secured along a midline of one sixth blade member, each seventh blade member extending radially outward from said common linear axis;

each said first, second, third, fifth and seventh radially extending planar blade member having a double tapered cutting edge facing said entry end of said splitting blade assembly;

each said fourth and each said sixth bridging blade member having a single tapered cutting edge facing said entry end of said splitting blade assembly; and said first, said second, said third, said fourth, said fifth, said sixth and said seventh blade members are positioned such that contact of said splitting blade assembly with a log section entering said entry end thereof is in the sequence, said first blade member, said second blade member, said third blade member, said fourth blade members, said fifth blade members, said sixth blade members and said seventh blade members.

19. The staged contact splitting blade assembly having an entry end and an exit end of claim 18, wherein said single tapered cutting edges facing said entry end of said splitting blade assembly of a first set of three alternating said fourth blade members are in a first plane and a second set of three alternating said fourth blade members are in a second plane offset from said plane of said first set of said fourth blade members.

20. The staged contact splitting blade assembly having an entry end and an exit end of claim 18, wherein said cutting edge of said fifth blade members and said cutting edge of said seventh blade member extends toward said entry end of said splitting blade assembly as each said blade member's cutting edge extends away from said common linear axis of said splitting blade assembly.

* * * * *